United States Patent [19]

Pollard

[11] Patent Number: 4,902,998

[45] Date of Patent: Feb. 20, 1990

[54] INDUCTOR ASSEMBLY WITH COOLED WINDING TURNS

[75] Inventor: David D. Pollard, Cridersville, Ohio

[73] Assignee: Westinghouse Electric Corp., Pittsburgh, Pa.

[21] Appl. No.: 274,103

[22] Filed: Nov. 21, 1988

[51] Int. Cl.[4] ..... H01F 27/08; H01F 27/28

[52] U.S. Cl. ..... 336/60; 336/61; 336/223

[58] Field of Search ..... 336/55, 57, 58, 60, 336/61, 223; 310/64, 65

[56] References Cited

U.S. PATENT DOCUMENTS

| | | | |
|---|---|---|---|
| 531,996 | 1/1895 | Hassler | 336/60 |
| 1,723,840 | 8/1929 | Burnham | 336/60 |
| 1,852,805 | 4/1932 | Frank | 336/223 |
| 2,765,448 | 10/1956 | Duffing | 336/223 X |
| 2,907,968 | 10/1959 | Thurk | 336/223 X |

FOREIGN PATENT DOCUMENTS

| | | | |
|---|---|---|---|
| 665334 | 5/1979 | U.S.S.R. | 336/223 |

*Primary Examiner*—Thomas J. Kozma
*Attorney, Agent, or Firm*—R. P. Lenart

[57] ABSTRACT

An inductor assembly is provided with turns of a coil conductor that encircle a leg of a magnetic core and are insulated from the core. Each of the turns includes a portion which extends through an aperture in the core and a second portion positioned outside the aperture. The surface area per unit length of the second portions of selected turns is greater than the surface area of the portions of the turns which extend through the aperture. These portions of increased surface area are spaced apart to permit the flow of cooling medium between the turns.

7 Claims, 5 Drawing Sheets

INDUCTOR ASSEMBLY WITH COOLED WINDING TURNS

BACKGROUND OF THE INVENTION

This invention relates to coils in electrical devices and, more particularly, to the coils of transformers and inductors.

Power inverters, converters and like apparatus include inductors or transformers which must carry high currents in their coils. The size and weight of these device is dependent upon the ability to dissipate heat produced by this current flow. High current inductors have been constructed with a single layer wound coil with the coil being exposed to some cooling media such as air or oil. To improve cooling, individual turns of the coil have been spaced apart so that the coolant will reach the sides of each turn in addition to the outer edges of the turn. Even with single layer coils having spaced apart turns, these devices may represent a large percentage of the inverter or converter's total weight.

It is therefore desirable to produce coils with improved heat dissipating features such that they are smaller and lighter than prior art coils which were subjected to the same current loading.

SUMMARY OF THE INVENTION

Inductor assemblies constructed in accordance with this invention include a magnetic core and a coil having a plurality of turns of a conductor which encircles a leg of the core. The conductor is insulated from the core and each of the turns includes a first portion positioned within an aperture in the core and a second portion positioned outside of the aperture. The second portions of each of the turns are spaced apart, thereby permitting flow of cooling medium between the second portions. The surface area per unit length of the first portions of the turns is less than the surfaced area per unit length of the second portions of the turns.

Since the second portions of the turns include a relatively large surface area, these portions can be exposed to a cooling medium to improve heat dissipation. At the same time, the portions of the turns which extend through the core can be made smaller, thereby reducing core size by reducing the required aperture area. The coils used in this invention can be fabricated using well known sheet metal technology.

DESCRIPTION OF THE PREFERRED EMBODIMENT

Figure 1:
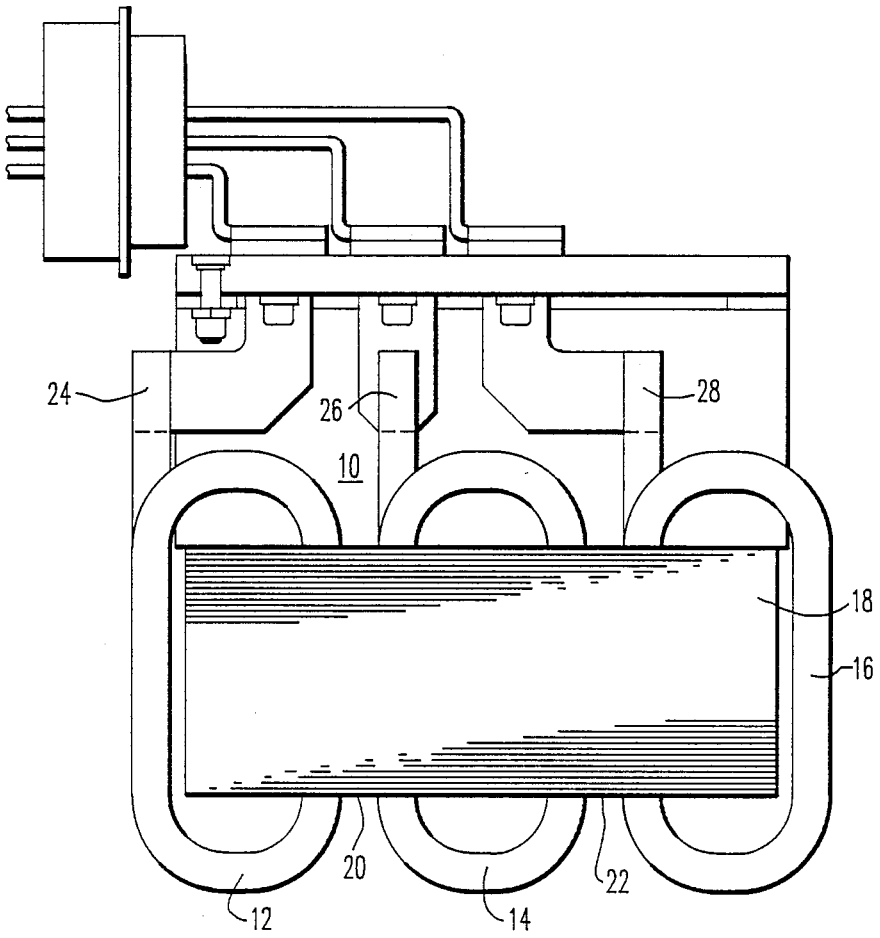
FIG. 1 PRIOR ART
FIGS. 1 and 2 are top and end views of a prior art inductor assembly.
Figure 2:
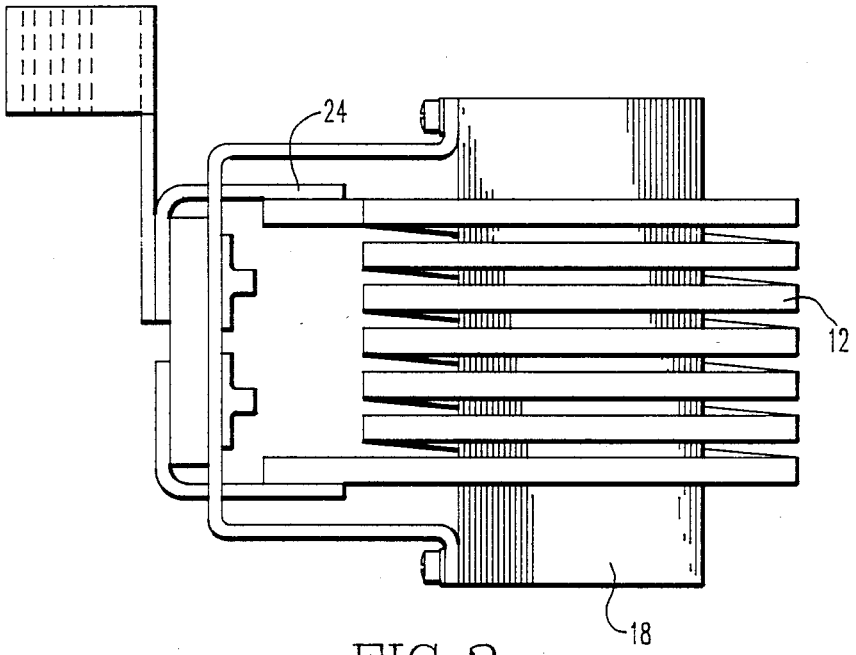
FIG. 2 PRIOR ART

The present invention can be most easily understood by contrasting its preferred embodiment with the prior art inductor assembly illustrated in FIGS. 1 and 2. That assembly 10 includes three coils 12, 14 and 16 which are wound in single layers about separate legs of a laminated magnetic core 18. Portions of each of the coils pass through apertures 20 and 22 in the core. Bus bars 24, 26 and 28 provide electrical connections to the circuit of an associated power apparatus. As illustrated in FIG. 2, coil 12 includes a plurality of turns of a conductor having a rectangular cross-section. These turns are spaced apart so that cooling medium can contact the sides and outer edges of each turn.

Figure 3:
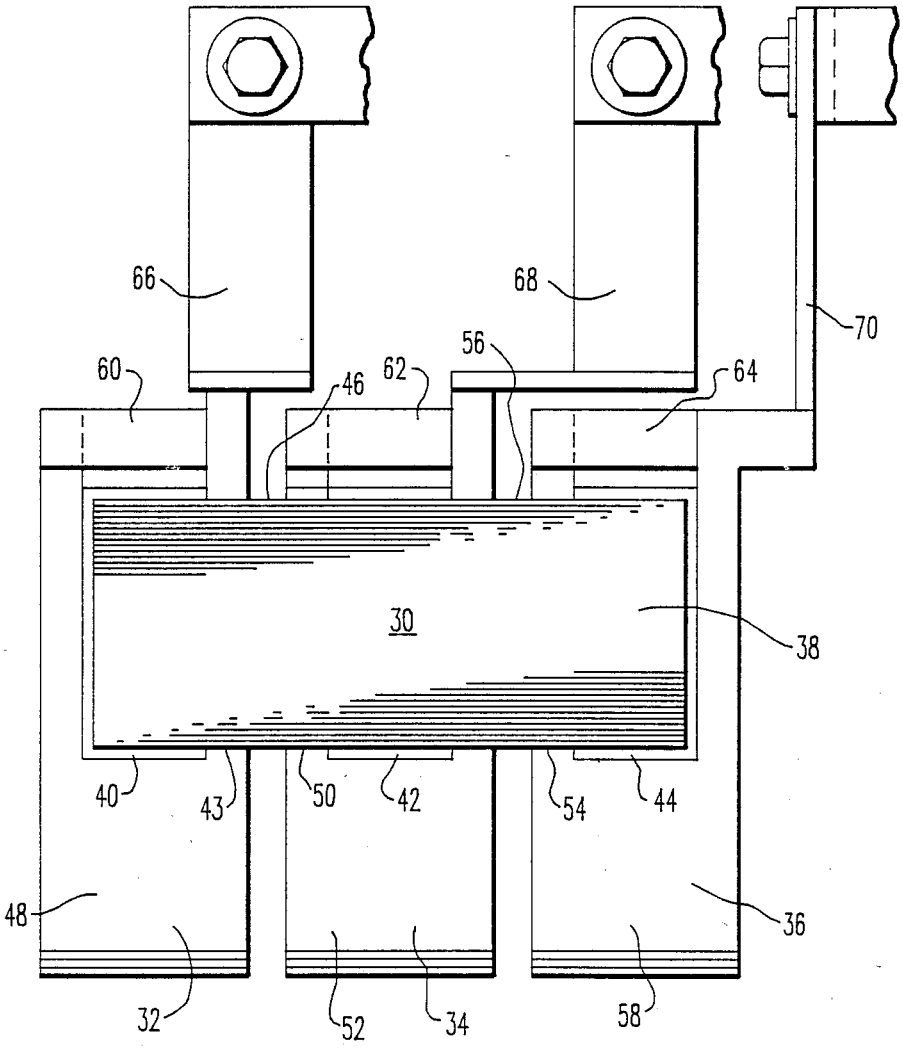
FIGS. 3, 4 and 5 are top side and end views of an inductor assembly constructed in accordance with the preferred embodiment of the present invention.
Figure 4:
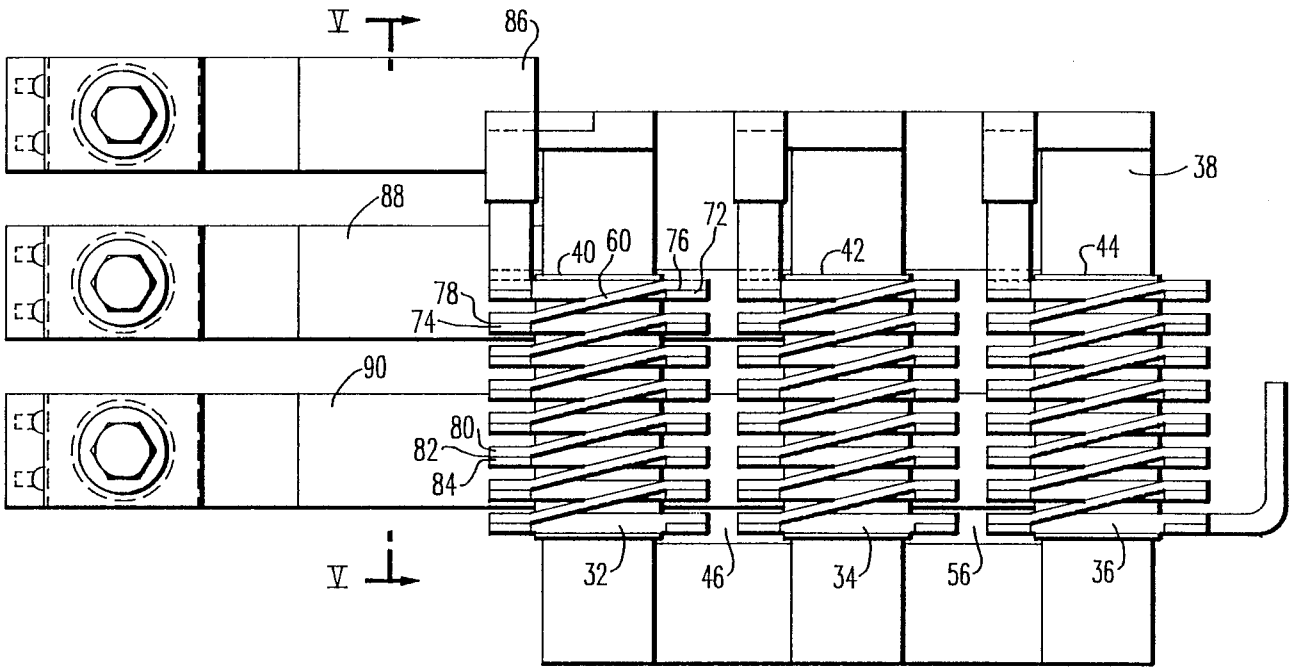
Figure 5:
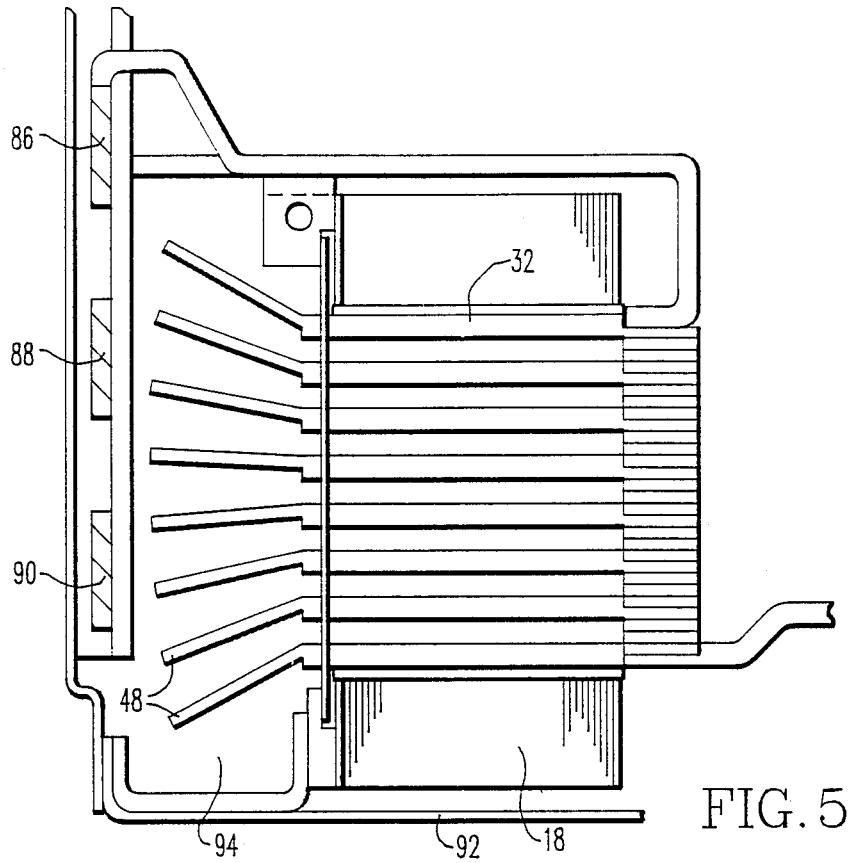

The present invention as illustrated in FIGS. 3, 4 and 5 improves heat dissipation in the inductor assembly by providing at least some of the coil turns with a portion of increased surface area which may be subjected to a cooling medium. FIG. 3 is a top view of an inductor assembly 30 constructed for three phase operation and having three coils 32, 34 and 36 wound around three legs of a laminated magnetic core 38. Insulating sleeves 40, 42 and 44 encompass the core legs and insulate the coil conductors from the core. Each of the turns of coil 32 includes a first portion 42 which extends through an aperture 46 in the core. A second portion 48 is positioned outside of the core aperture and has a larger surface area per unit length than the first portion. The second portion of each of the turns may be strategically placed within the power apparatus such that it is subject to a flow of cooling medium such as air or oil.

The turns of coil 34 include a first portion 50 which also passes through aperture 46 and a second portion 52. Similarly, the turns of coil 36 include a first portion 54 which passes through an aperture 56 in core 38 and a second portion 58. Individual turns of coils 32, 34 and 36 are electrically connected in series with each other by generally straight members 60, 62 and 64 respectively Bus bars 66, 68 and 70 are used to connect the coils to an external circuit.

The method of interconnecting individual turns of the coils is illustrated in FIG. 4. Generally straight member 60 is shown to extend from one end of the generally U-shaped member 72 to one end of a second generally U-shaped member 74. The ends of the U-shaped members and straight members are connected by welding or brazing to form joints 76 and 78. This construction technique is used throughout each coil of the assembly as further illustrated for coil 32 wherein generally straight member 80 is brazed or welded to one end of generally U-shaped member 82 at joint 84. Bus bars 86, 88 and 90 provide coils 32, 34 and 36 respectively with additional connections to an external circuit.

The end view of FIG. 5 shows the inductor assembly mounted in a portion of a housing 92 which forms a coolant passage 94. The enlarged portions 48 of the turns of coil 32 extend into the coolant passage and are flared apart as shown to improve heat transfer between coolant in the passage and the turns of the coil.

Figure 6:
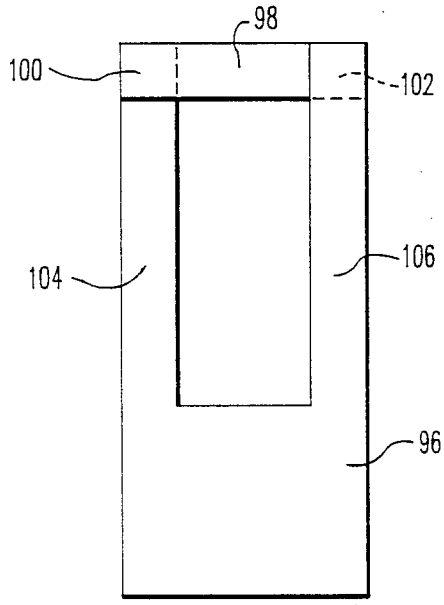
FIG. 6. is a plan view of one of the inductor coil turns of the preferred embodiment of this invention.

The coils in the preferred embodiment inductor assembly of this invention are unique in that they are fabricated using sheet metal technology. As illustrated in the plan view of one of the coil turns of FIG. 6, each turn is made from a generally U-shaped portion 96 and a generally straight or I-shaped bar 98. The ends of the U-shaped member and I-shaped bar are coined to assure correct assembly. This coining creates a recessed area at the ends 100 and 102 of the legs 104 and 106 of the U-shaped member 96 to cradle the ends of the I-shaped member 98. The ends of the U and I are brazed or welded together to create each turn. One end of one leg of the U-shaped member is connected to one end of the I-shaped member and the end of the other leg of the U-shaped member is connected to another I-shaped member.

It should be apparent to those skilled in the art that by utilizing coil turns having a portion of increased surface area, inductor assemblies constructed in accordance with this invention require a smaller core aperture and can therefore be fabricated with a reduced core size. Although the coil conductors illustrated in the preferred embodiment have a rectangular cross-section, alternative embodiments may include square, round, triangular or other cross-sections as required to enhance cooling, terminations and penetrations through the core aperture. This flexibility in design is made possible by using sheet metal forming in the preparation of the coil conductor. Core size is reduced by reduction of the required window area. Cooling is improved by increasing the size of the coil conductor only in that portion which is exposed to the cooling medium. The segment of the coil conductor that goes through the core window is decreased in size. With sheet metal construction, the coil may be formed to exactly conform to the core thus achieving the shortest possible mean turn length. It should be understood that the shape of the coil conductor does not have to be maintained for a full turn nor for any side of a turn. The cross-section is variable to the limits of fabrication or processing technology.

Although the present invention has been described in terms of what is at present believed to be its preferred embodiment, it will be apparent to those skilled in the art that various changes may be made without departing from the scope of the invention. It is therefore intended that the appended claims cover such changes.

What is claimed is:

1. An inductor assembly comprising:

a magnetic core having a first leg and shaped to form a first aperture for receiving a first coil;

said first coil including a plurality of turns of a first conductor encircling said first leg;

means for insulating said first conductor from said core;

each of said turns including a first portion positioned within said first aperture and a second portion positioned outside of said first aperture;

said second portions of said turns being spaced apart thereby permitting flow of cooling medium between said second portions;

the surface area per unit length of said first portions of selected ones of said turns being less than the surface area per unit length of said second portions of said selected turns; and means for exposing only said second portions of said selected ones of said turns to said cooling medium.

2. An inductor assembly as recited in claim 1, wherein:

said first conductor includes a generally rectangular cross section with a variable width; and the width of said first conductor positioned outside of said first aperture is greater than the width of said first conductor within said first aperture.

3. An inductor assembly as recited in claim 1, wherein:

said second portions of the turns of said first conductor are flared apart.

4. An inductor assembly as recited in claim 1, wherein:

each of said turns includes a generally U-shaped member; and opposite ends of adjacent ones of said U-shaped members are electrically connected by a generally straight member.

5. An inductor assembly as recited in claim 4, wherein:

each of said ends of said U-shaped members is coined; and opposite ends of said generally straight member are coined, said coined ends of said U-shaped members and said generally straight members being brazed together.

6. An inductor assembly as recited in claim 1, further comprising:

second and third coils;

said magnetic core further including second and third legs and being shaped to form a second aperture for receiving said second and third coils;

said second coil including a plurality of turns of a second conductor encircling said second leg;

means for insulating said second conductor from said core;

each of said turns of said second conductor including a first portion positioned within said first aperture and a second portion positioned outside of said first aperture;

wherein said second portions of said second conductor turns are spaced apart thereby permitting flow of cooling medium between said second portions of said second conductor;

wherein the surface area per unit length of said first portions of selected ones of said second conductor turns is less than the surface area per unit length of said second portions of said selected second conductor turns;

said third coil including a plurality of turns of a third conductor encircling said third leg;

means for insulating said third conductor from said core;

each of said third conductor turns including a first portion positioned within said second aperture and a second portion positioned outside of said second aperture;

wherein said second portions of said third conductor turns are spaced apart thereby permitting flow of cooling medium between said second portions of said third conductor; and wherein the surface area per unit length of said first portions of selected ones of said third conductor turns is less than the surface area per unit length of said second portions of said selected third conductor turns.

7. An inductor assembly as recited in claim 1, wherein said means for exposing only said second portions of said selected ones of said turns to said cooling medium comprises:

a housing forming a coolant passage, wherein said second portions of said selected ones of said turns are positioned within said coolant passage.

* * * * *